US005816075A

United States Patent [19]

Lonati et al.

[11] Patent Number: 5,816,075

[45] Date of Patent: Oct. 6, 1998

[54] SINGLE-CYLINDER CIRCULAR HOSIERY MACHINE WITH PIVOTABLE DIAL SECTIONS

[75] Inventors: Francesco Lonati; Ettore Lonati; Fausto Lonati; Tiberio Lonati, all of Brescia, Italy

[73] Assignee: Lonati S.p.A., Monza, Italy

[21] Appl. No.: 820,629

[22] Filed: Mar. 19, 1997

[30] Foreign Application Priority Data

Apr. 22, 1996 [IT] Italy ..... MI96A0789

[51] Int. Cl.[6] ..... D04B 9/56

[52] U.S. Cl. ..... 66/28; 66/16; 66/148; 66/187

[58] Field of Search ..... 66/16, 15, 28, 66/30, 187, 148, 34, 63, 31, 32

[56] References Cited

U.S. PATENT DOCUMENTS

| | | | |
|---|---|---|---|
| 1,807,431 | 5/1931 | Page | 66/48 |
| 4,454,729 | 6/1984 | Lonati | 66/28 |
| 5,203,184 | 4/1993 | Lonati et al. | 66/28 |

FOREIGN PATENT DOCUMENTS 1 346 518 11/1962 France .

16 35 992 7/1971 Germany .

*Primary Examiner*—Andy Falik

*Attorney, Agent, or Firm*—Guido Modiano; Albert Josif

[57] ABSTRACT

A single-cylinder circular hosiery-making or knitting machine particularly for manufacturing tubular items closed at one of their axial ends, having a needle cylinder and a circular plate which coaxially faces the needle cylinder in an upward region. The circular plate is composed of two halves, a first half of which is pivoted to a first supporting structure about a diametrical axis which is substantially parallel to the diametrical connecting plane of the two halves of the circular plate. The first half of the circular plate is also provided with radial grooves which accommodate pairs of hooks which can be actuated along the corresponding groove so as to engage or release loops or portions of loops of knitting formed by the needles of the needle cylinder. Elements are provided for overturning the first half of the circular plate about the diametrical axis to transfer it from a first position, which is co-planar with respect to a second half of the circular plate, to a second position, which is overturned below the second half of the circular plate, and viceversa. The first half of the circular plate is rotatable, in the second position, rigidly with the needle cylinder about tile axis of the needle cylinder with respect to the second half of the circular plate.

10 Claims, 5 Drawing Sheets

80
81
81a
9
20
29
12
18
19
40
36
30
15
31
17
27
37
39a
38
35
39
60
62
41
45
34
23
63
44
57
64
61
54
53
50
8
33
55
43
42
51b
16
56
25
24
22
13
52
51a 80
81
81a
9
20
29
12
19
18
40
36
30
31
39a
15
17
37
27
38
35
39
60
41
62
45
23
34
63
44
57
64
33
61
51b
54
16
56
42
22
13
50
51a
8
55
43
24
25
52

SINGLE-CYLINDER CIRCULAR HOSIERY MACHINE WITH PIVOTABLE DIAL SECTIONS

BACKGROUND OF THE INVENTION

The present invention relates to a single-cylinder circular hosiery-making or knitting machine particularly for manufacturing tubular items closed at one of their axial ends.

Conventional single-cylinder circular hosiery-making or knitting machines generally comprise a needle cylinder which is arranged so that its axis is vertical and has, on its skirt, a plurality of axial grooves inside each whereof a needle is provided which can be actuated with a reciprocating motion along the corresponding groove, by means of actuation cams arranged around the skirt of the needle cylinder, when the needle cylinder is rotated about its own axis with respect to the actuation cams.

A circular plate is generally arranged above the needle cylinder and coaxially thereto; the circular plate has a plurality of radial grooves, wherein hooks are accommodated which can be actuated, by means of adapted actuation cams facing the circular plate in an upward region, as a consequence of the rotation of the circular plate together with the needle cylinder about its own axis with respect to the hook actuation cams, so as to cause the movement of the hooks in a radial direction and make them protrude, with their tip, from the corresponding grooves laterally to the circular plate, arranging themselves between two contiguous needles of the needle cylinder in order to engage loops or loop portions formed by the needles of the needle cylinder, or so as to retract into the grooves of the circular plate.

The circular plate, or rather the hooks of the circular plate, are generally used to form a turned-back hem at one end of the knitted tubular item that can be produced with these machines. In practice, in single-cylinder hosiery-making machines the circular plate is used to form a tubular hem at the top of the hosiery item. This knitting is performed by moving the hooks of the circular plate so that they protrude laterally from the plate, so as to engage loops of knitting formed by the needles and retain them during the formation of a few rows of knitting. The loops held by the hooks are then returned to the needles so as to form a turned-back hem, i.e., a hem having a tubular configuration.

In recent years it has been thought to use single-cylinder circular hosiery-making machines to form, directly on the machine, hosiery items having a closed toe, or more generally to close the tubular item at one of its axial ends.

A machine of this kind is disclosed for example in German patent 16.35.992, which has, as an alternative to the circular plate, an element which can be likened to a semicircular plate, i.e., one which covers substantially 180° around the axis of the needle cylinder. This element or semicircular plate is rotatable on command around a diametrical axis of the needle cylinder, so that it can alternately face the needles of one half of the needle cylinder and the needles of the opposite half of the needle cylinder.

This possibility of overturning the semicircular plate is used to transfer the loops formed by the needles of one half of the needle cylinder to the needles of the other half of the needle cylinder, so as to knit the loops formed by the needles of one half of the needle cylinder in with the loops formed by the needles of the other half of the needle cylinder in order to close the tubular item.

Use of a semicircular plate as shown in German patent 16.35.992, although allowing to produce tubular items which are closed at one of their axial ends, entails the drawback of having to renounce the use of a conventional circular plate and therefore of not being able to produce items having a turned-back hem, i.e., a tubular hem at one end of the item or, more generally, of not being able to perform operations which can typically be obtained only by using a conventional circular plate.

SUMMARY OF THE INVENTION

A principal aim of the present invention is to solve the above problem by providing a single-cylinder circular hosiery-making or knitting machine which can produce tubular items closed at one of their axial ends directly on the machine without renouncing the knitting operations which can be typically obtained with a conventional circular plate.

Within the scope of this aim, an object of the present invention is to provide a single-cylinder circular machine which allows to very precisely transfer loops of knitting from the needles of one half of the needle cylinder to the needles of the other half of the needle cylinder in order to obtain an item which is closed at one of its axial ends.

Another object of the present invention is to provide a single-cylinder circular hosiery-making or knitting machine which is highly reliable in operation in transferring the loops from the needles of one half of the needle cylinder to the needles of the other half of the needle cylinder.

Another object of the present invention is to provide a single-cylinder circular hosiery-making or knitting machine which can transfer the loops from the needles of one half of the needle cylinder to the needles of the other half of the needle cylinder in a very short time, so as to avoid excessively penalizing the production potential of the machine.

This aim, these objects, and others which will become apparent hereinafter are achieved by a single-cylinder circular hosiery-making or knitting machine particularly for manufacturing tubular items closed at one of their axial ends, comprising a needle cylinder and a circular plate which coaxially faces the needle cylinder in an upward region, characterized in that said circular plate is composed of two halves, a first half of the circular plate being pivoted to a first supporting structure about a diametrical axis which is substantially parallel to the diametrical connecting plane of the two halves of the circular plate; said first half of the circular plate being provided with radial grooves which accommodate pairs of hooks which can be actuated along the corresponding groove so as to engage or release loops or portions of loops of knitting formed by the needles of the needle cylinder; overturning means being provided for overturning said first half of the circular plate about said diametrical axis to transfer it from a first position, which is co-planar with respect to a second half of the circular plate, to a second position, which is overturned below said second half of the circular plate, and viceversa, said first half of the circular plate being rotatable, in said second position, rigidly with the needle cylinder about the axis of the needle cylinder with respect to said second half of the circular plate.

BRIEF DESCRIPTION OF THE DRAWINGS

Further characteristics and advantages of the invention will become apparent from the following detailed description of a preferred but not exclusive embodiment of the machine according to the invention, illustrated only by way of non-limitative example in the accompanying drawings, wherein:

FIG. 1 is an axial sectional view of the circular plate of the machine according to the present invention;

DESCRIPTION OF THE PREFERRED EMBODIMENTS

Figures 1A, 2:
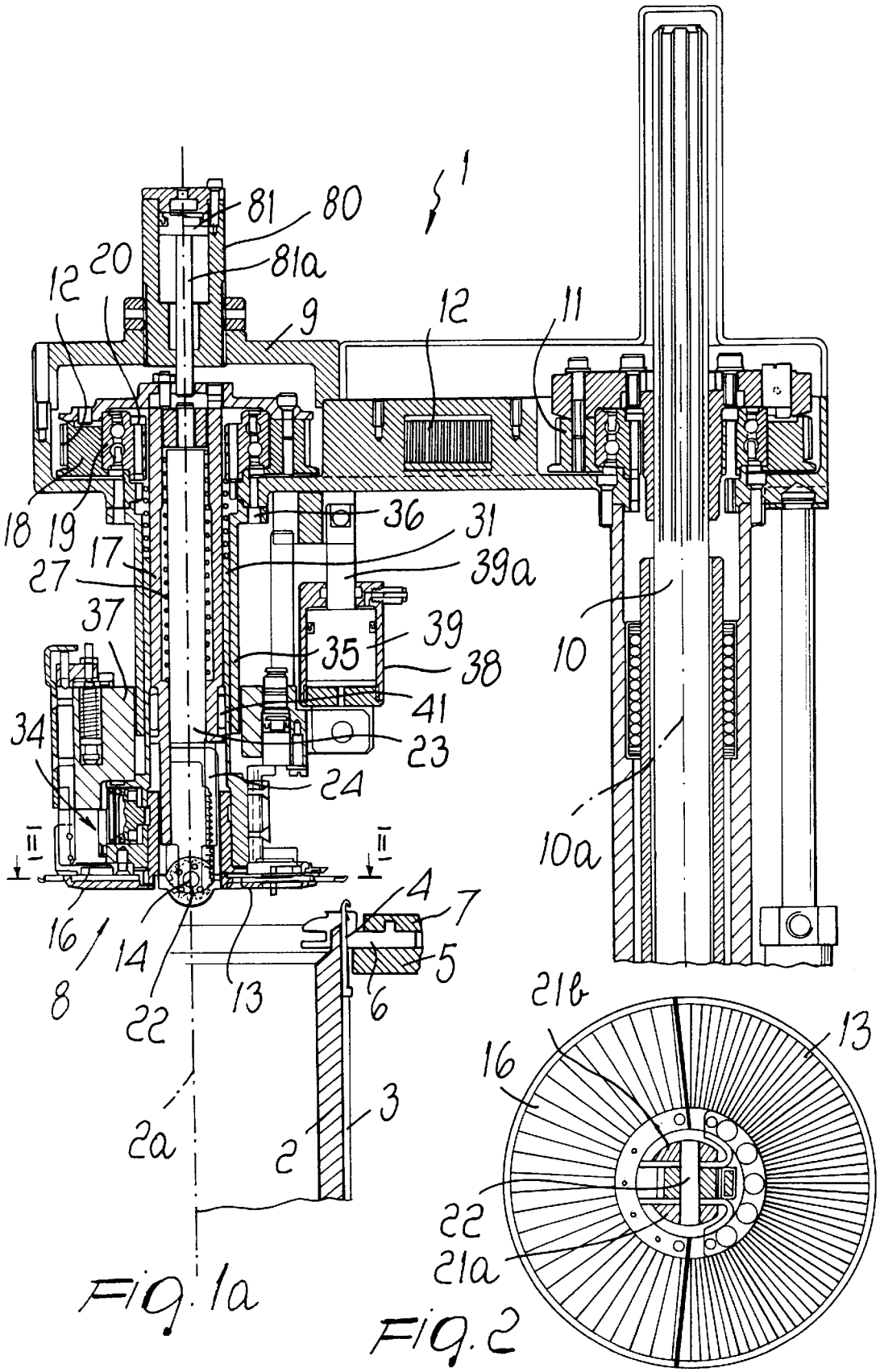
FIG. 2 is a schematic sectional view of FIG. 1, taken along the plane II—II.

With reference to the above figures, the machine according to the present invention, generally designated by the reference numeral 1, comprises, in a per se known manner, a needle cylinder 2 which is arranged so that its axis 2*a* is vertical and has, on its outer skirt, a plurality of grooves 3, each whereof accommodates a needle 4, said needle being actuatable reciprocatingly along the corresponding groove by means of actuation cams, not illustrated for the sake of simplicity, which laterally face the skirt of the needle cylinder 2 when the needle cylinder is rotated about its own axis 2*a* with respect to the actuation cams.

The needle cylinder 2 is provided, in a per se known manner, with a sinker ring 5 that supports a plurality of sinkers 6, which can be actuated, in a per se known manner, by means of adapted cams 7 facing the sinker ring 5 in an upward region. These details of the machine have been shown only schematically in FIG. 1 since they relate to conventional elements.

The machine also comprises a circular plate, generally designated by the reference numeral 8, which is arranged in an upward region and coaxially with respect to the needle cylinder 2.

The circular plate 8 is supported, so that it can rotate about the axis 2*a*, by a portion 9 of the supporting structure of the machine, and the rotary motion of the needle cylinder 2 about the axis 2*a* is transmitted to the circular plate 8 by a transmission shaft 10 arranged so that its axis 10*a* is parallel to the axis 2*a* and is spaced laterally with respect to the needle cylinder 2.

The portion 9 of the supporting structure of the machine is movable on command, in a per se known manner, parallel to the axis 2*a* so as to allow the lowering or lifting of the circular plate 8 with respect to the needle cylinder 2.

A toothed pulley 11 is keyed on the shaft 10 and transmits the rotary motion of the shaft 10, which is synchronized with the rotation of the needle cylinder 2, to the circular plate 8 by means of a toothed belt 12, as will become apparent hereinafter.

The circular plate 8 is constituted by two halves, and a first half 13 is pivoted to a first supporting structure 15 about a diametrical axis 14 substantially parallel to the diametrical joining plane of the two halves of the circular plate 8.

More precisely, it should be specified that the first half 13 of the circular plate has a slightly larger angular extension than a second half 16 of the circular plate, as shown in FIG. 2, which clearly illustrates the coupling line between the two halves 13 and 16 of the circular plate 8.

In the machine according to the invention there are provided means for overturning the first half 13 of the circular plate about the diametrical axis 14 to transfer it from a first position, in which it is co-planar to the second half 16 of the circular plate, to a second position, in which said first half 13 of the circular plate is overturned below the second half 16 of the circular plate, and viceversa. The first half 13 of the circular plate can also rotate, in the overturned position, rigidly with the needle cylinder 2 about the axis 2*a* of the needle cylinder with respect to the second half 16 of the circular plate.

More particularly, the first supporting structure 15 comprises a first hollow shaft 17 the axis whereof coincides with the axis 2*a* and which is fixed, at its upper end, to a pulley 18 with which the toothed belt 12 meshes.

The first hollow shaft 17 is rotatably supported about the axis 2*a* by the portion 9 of the supporting structure by means of a bearing 19, the inner ring whereof is fixed to the portion 9 by screws 20.

The lower end of the first hollow shaft 17 has two parallel flanges 21*a* and 21*b* which support the first half 13 of the circular plate by means of a pivot 22. The axis of the pivot 22 constitutes the diametrical axis 14.

A shaft 23 is coaxially accommodated, so that it can slide along the axis 2*a*, inside the first hollow shaft 17 and is connected, at its lower end, to a rack 24 which is arranged parallel to the axis 2*a* and meshes with a pinion 25 arranged coaxially about the pivot 22. The pinion 25 is fixed, as shown in FIG. 2, to the first half 13 of the circular plate so that the actuation of the rack 24 along the axis 2*a* causes the partial rotation of the first half 13 of the circular plate about the diametrical axis 14 with respect to the second half 16 of the circular plate.

The sliding of the shaft 23 along the axis 2*a* with respect to the first hollow shaft 17 towards the needle cylinder 2, i.e. downwards, is elastically contrasted by a helical spring 27, which is arranged around the shaft 23 and engages, with one of its axial ends, a shoulder 28 formed inside the first hollow shaft 17 and, with its other axial end, a cylindrical block 29 which is fixed to the upper end of the shaft 23 and can slide along the inner surface of the first hollow shaft 17.

The means for overturning the first circular plate half 13 comprise, in addition to the shaft 23, to the rack 24, to the pinion 25, and to the spring 27, a fluid-actuated cylinder 80 which is associated, in an upward region, with the portion 9 and faces the upper end of the shaft 23 with the end of a stem 81*a* of its piston 81. The actuation of the fluid-actuated cylinder 80 causes the downward sliding of the shaft 23 inside the first hollow shaft 17 in contrast with the action of the spring 27 and, by means of the rack 24-pinion 25 coupling, the overturning of the first circular plate half 13 about the diametrical axis 14. The overturning of the first circular plate half 13 in the opposite direction is achieved by discharging the fluid-actuated cylinder 80, so that the shaft 23 is raised again by the action of the spring 27.

The second half 16 of the circular plate is supported by a second supporting structure 30, which comprises a second hollow shaft 31 arranged coaxially and externally with respect to the first hollow shaft 17.

The lower end of the second hollow shaft 31 is connected to a block 33 which supports means 34 for retaining and locking the second circular plate half 16, as will become apparent hereinafter.

Conveniently, means are provided for moving the second supporting structure 30 along the axis 2*a* with respect to the first supporting structure 15 or with respect to the first circular plate half 13 in order to move the second circular plate half 16 from a position which is co-planar to the first circular plate half 13 to a position which is spaced above the first circular plate half 13 and viceversa.

More particularly, the second hollow shaft 31 is coupled to the first hollow shaft 17, so that is can slide along the axis 2*a*, by means of its inner surface and is coupled, by means of its outer surface, to a third hollow shaft 35, the axis whereof coincides with the axis 2*a* and is fixed, at its upper end, for example by means of screws 36, to the portion 9 of the supporting structure.

The block 33 is fixed to another block 37, which lies around the third hollow shaft 35 and is connected to the end of a fluid-actuated cylinder 38. The fluid-actuated cylinder 38, which can be constituted for example by a single-action pneumatic cylinder, accommodates a piston 39 which is fixed to the portion 9 of the supporting structure by means of its stem 39*a*, which is parallel to the axis 2*a*.

In practice, the actuation of the fluid-actuated cylinder 38 which occurs by feeding pressurized fluid above the piston 39 lifts the body of the cylinder 38 with respect to the piston 39 and therefore lifts the second supporting structure 30 and therefore the second half 16 of the circular plate with respect to the first structure 15 and therefore to the first half 13 of the circular plate.

The lifting of the second supporting structure 30 with respect to the first supporting structure 15 is elastically contrasted by a spring 40 interposed between the upper end of the second hollow shaft 31 and the portion 9 of the supporting structure.

It should be noted that the second supporting structure 30 is movable vertically along the axis 2*a* but cannot rotate about said axis, and rotatably supports, about the axis 2*a*, the second half 16 of the circular plate. A bearing 41 for the rotation of the first hollow shaft 17 about the axis 2*a* with respect to the second supporting structure 30 is interposed between the second hollow shaft 31 of the second supporting structure 30 and the first hollow shaft 17 of the first supporting structure 15.

The second half 16 of the circular plate is fixed to the lower end of a portion of a hollow shaft 42 which is arranged between the first hollow shaft 17 and a cylindrical seat formed in the block 33 coaxially to said first hollow shaft 17.

Said hollow shaft portion 42 is coupled to the outer surface of the first hollow shaft 17 by means of its internal surface, so that it can rotate about the axis 2*a*, and is coupled to the cylindrical seat 43 formed in the block 33 by means of its outer surface.

The retention and locking means 34 of the second half 16 of the circular plate comprise a fluid-actuated cylinder 44, which is formed inside said block 33 and accommodates, so that it can slide at right angles to the axis 2*a*, a piston 45 which can engage, with one of its ends, a circumferential groove 46 formed on the outer skirt of the hollow shaft portion 42.

The actuation of the piston 45 towards the axis 2*a* causes the engagement of the piston 45 in the circumferential groove 46, contrasting the axial sliding of the hollow shaft portion 42 and, by friction, also contrasts the rotation of the hollow shaft portion 42 and therefore of the second half 16 of the circular plate about the axis 2*a* with respect to the second supporting structure 30, as will become apparent hereinafter.

A plurality of radial grooves 50 is formed in the first half 13 of the circular plate and accommodates pairs of hooks 51*a* and 51*b* which can be actuated along the corresponding groove 50 to engage and/or release loops or loop portions of knitting formed by the needles 4 of the needle cylinder 2.

More particularly, each pair of hooks comprises a hook 51*a* with an upward-facing tip and a hook 51*b* with a downward-facing tip.

The hook 51*a* with an upward-facing tip is also provided with a heel 52 protruding upwards, whilst the hook 51*b* with a downward-facing tip is provided with a heel 53 protruding downwards from the first half 13 of the circular plate.

The second half 16 of the circular plate is also provided with radial grooves 54, inside each whereof a hook 55 is provided, the tip whereof is directed upwards; the hook is provided, along its longitudinal extension, with a heel 56 also protruding upwards.

Actuation cams 57 are provided above the circular plate 16 and form paths for the heels of the hooks 51*a*, 51*b*, and 55 and are connected, in a downward region, to the block 33 so that, as a consequence of the rotation of the circular plate 8 about the axis 2*a*, the actuation cams 57 move the hooks inside the corresponding grooves in a radial direction.

It should be noted that, as will become apparent hereinafter, the hook actuation cams 57 are used both to actuate the hooks 51*a* and to actuate the hooks 51*b* of the first half 13 of the circular plate.

For the sake of completeness in description, it should be noted that a fluid-actuated cylinder 60 is arranged inside the block 37 to lift or lower a cutter 61 which is arranged, in a per se known manner, above the circular plate 8.

Moreover, another fluid-actuated cylinder 62 is also provided in the block 37 and, by means of a slider 63, actuates a moving portion 64 of the actuation cams of the hooks arranged in the circular plate.

The operation of the circular plate in the machine according to the invention is as follows. In the position shown in FIG. 1, i.e., with the first half 13 of the circular plate arranged so that it is co-planar with respect to the second half 16 of the circular plate, the circular plate 8 of the machine according to the invention can be used like a conventional circular plate, for example to form a tubular turned-back edge at an axial end of the tubular item knitted with the needles 4 of the needle cylinder 2 (FIG. 1).

In this operating condition, the second half 16 of the circular plate is supported in a direction which is parallel to the axis 2*a* and is rotated about said axis 2*a* of the first half 13 of the circular plate, which receives its rotation from the first hollow shaft 17 which, as mentioned, is connected to the toothed pulley 18 wherewith there meshes the toothed belt 12 for transmitting the movement which is synchronized with the rotation of the needle cylinder 2.

Figure 3:
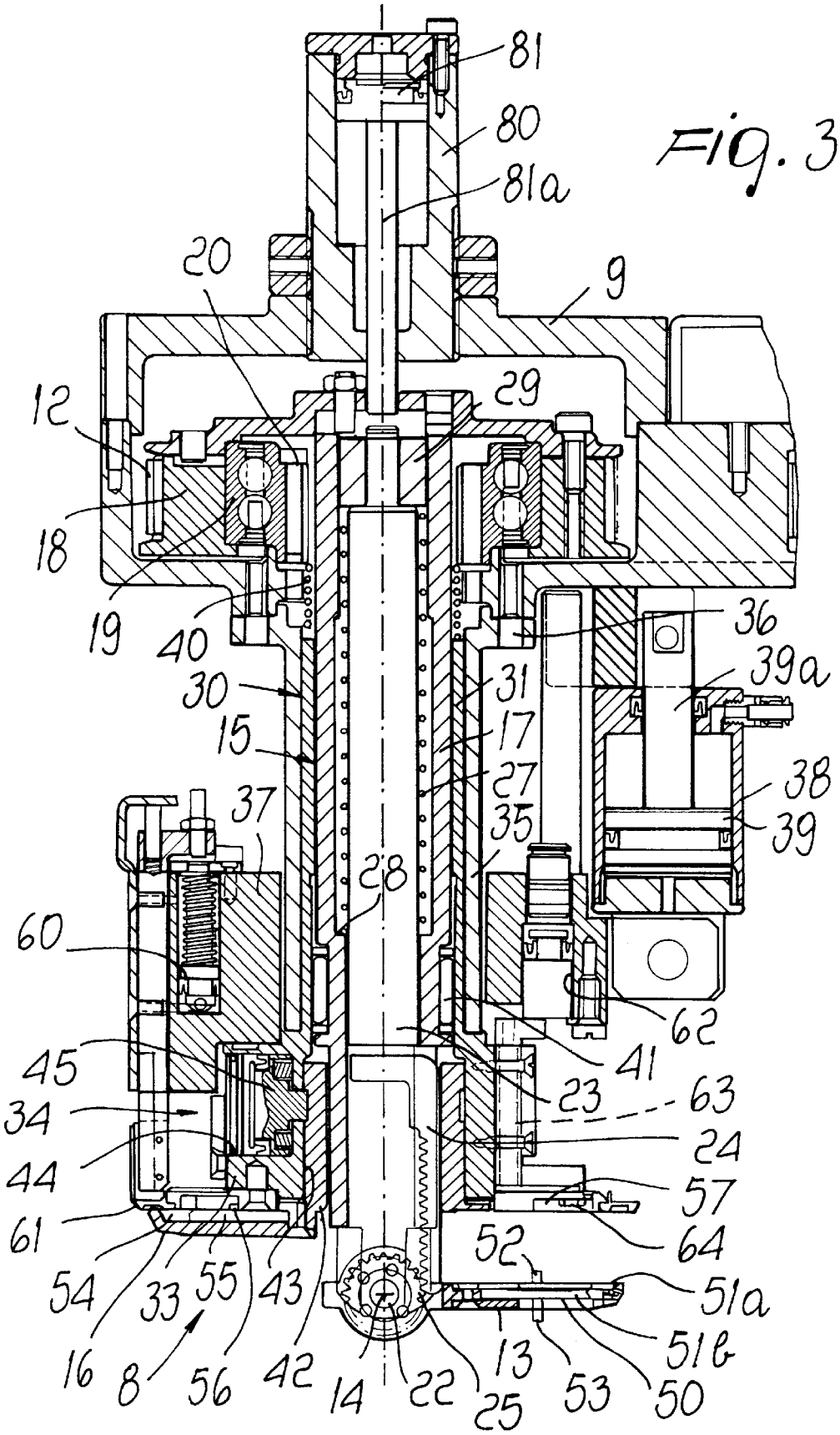
FIGS. 3 to 6 are axial sectional views of the various steps of the overturning of the first half of the circular plate about a diametrical axis of the circular plate, according to the present invention.

If it is necessary to transfer loops from the needles 4 of one half of the needle cylinder to the needles 4 of the other half of the needle cylinder, or if one wishes to transfer portions of loops previously held between the tips of the hooks 51*a* and 51*b* of the first half 13 of the circular plate to the needles of the opposite half of the needle cylinder, the portion 9 is lifted, in a per se known manner, with respect to the needle cylinder 2 so as to have, below the circular plate 8, a space which is sufficient to perform overturning. The fluid-actuated cylinder 38 is then fed with pressurized fluid and causes, as mentioned, the lifting of the second supporting structure 30, i.e., of the second hollow shaft 31, of the blocks 33 and 37, and therefore of the second half 16 of the circular plate with respect to the first supporting structure 15 and therefore above the first half 13 of the circular plate (FIG. 3).

It should be noted that before actuating the fluid-actuated cylinder 38, the fluid-actuated cylinder 44 is actuated so as to engage the piston 45 with the circumferential groove 46, in order to rigidly couple the second half 16 of the circular plate to the second supporting structure 30 during lifting along the axis 2*a*.

The engagement of the piston 45 with the circumferential groove 46 also locks, by friction, the rotation of the second half 16 of the circular plate around the axis 2*a*.

It should be noted that the piston 45 might be provided, as an alternative, with a transverse pin that engages a hole or a seat formed on the outer lateral surface of the hollow shaft portion 42.

Figure 4:
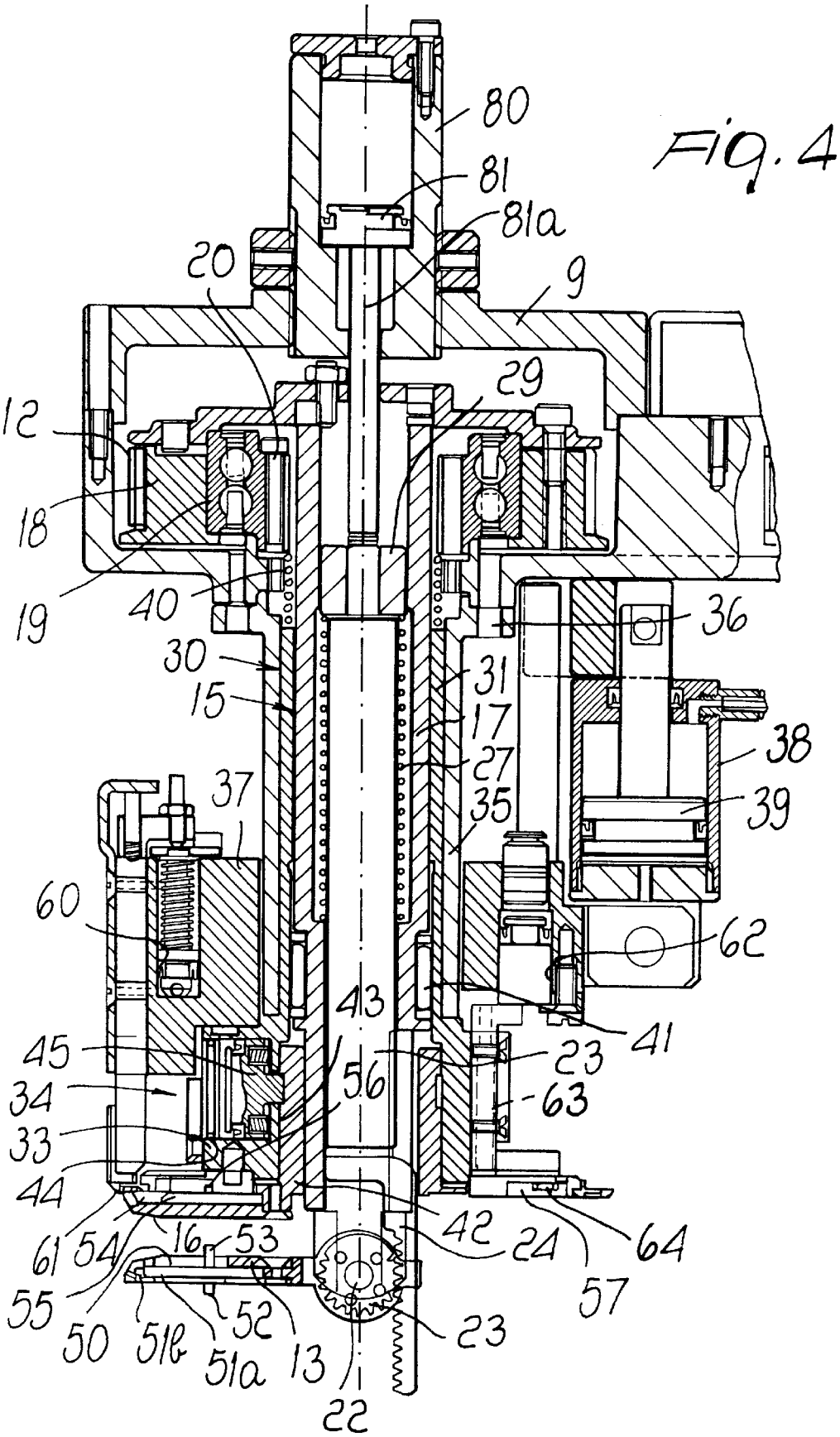

As a consequence of the actuation of the fluid-actuated cylinder 38, the first half 13 of the circular plate is at a lower level than the second half 16 of the circular plate. While the first half 13 of the circular plate is in this position, the fluid-actuated cylinder 80 is actuated and causes the downward axial movement of the shaft 23 with respect to the first hollow shaft 17, making the first half 13 of the circular plate rotate through 180° about the diametrical axis 14 by means of the rack 24, i.e., making it overturn (FIG. 4).

The diametrical axis 14 is preferably arranged substantially at the same level as a plane which is perpendicular to the axis 2*a* of the circular plate 8 and is equidistant from the recesses of the tips of the two hooks 51*a* and 51*b* of the various pairs of hooks of the first half 13 of the circular plate.

It should be noted that since the overturning axis 14 of the first half 13 of the circular plate is arranged practically at the same level as the tips of the hooks of the first half 13 of the circular plate, during overturning, any loops extending from the hooks located at the angular ends of the first half 13 of the plate to the corresponding needles of one half of the needle cylinder undergo minimal stretching, effectively avoiding their disengagement.

Figure 5:
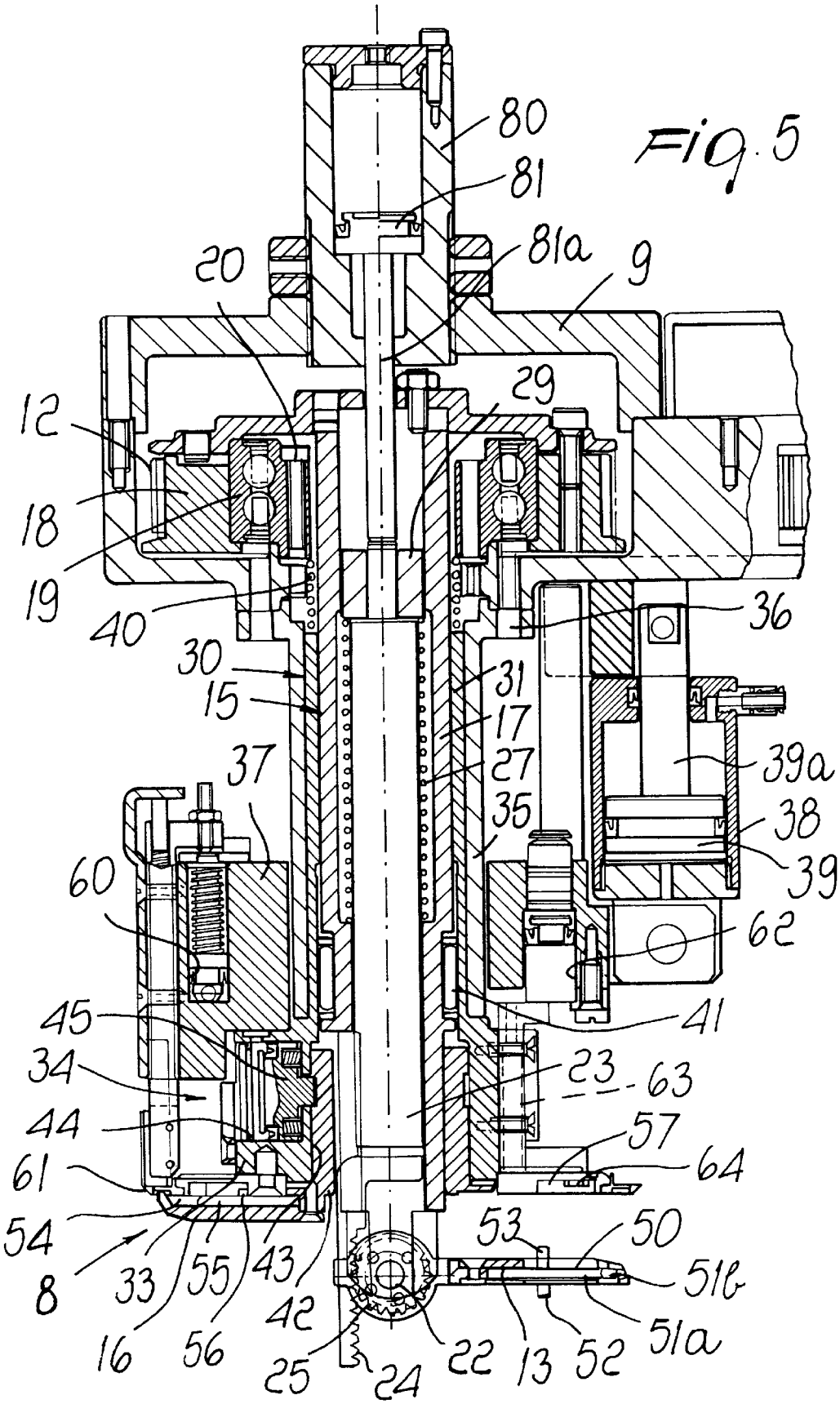

After the first half 13 of the circular plate has been overturned and arranged below the second half 16 of the circular plate, the needle cylinder 2 is rotated about its own axis 2*a* substantially through 180°. The first half 13 of the circular plate, being rigidly coupled to the needle cylinder in its rotation about the axis 2*a*, undergoes an equal rotation, continuing to face the needles 4 of the needle cylinder which it was made to face through the previously performed overturning (FIG. 5).

Figure 6:
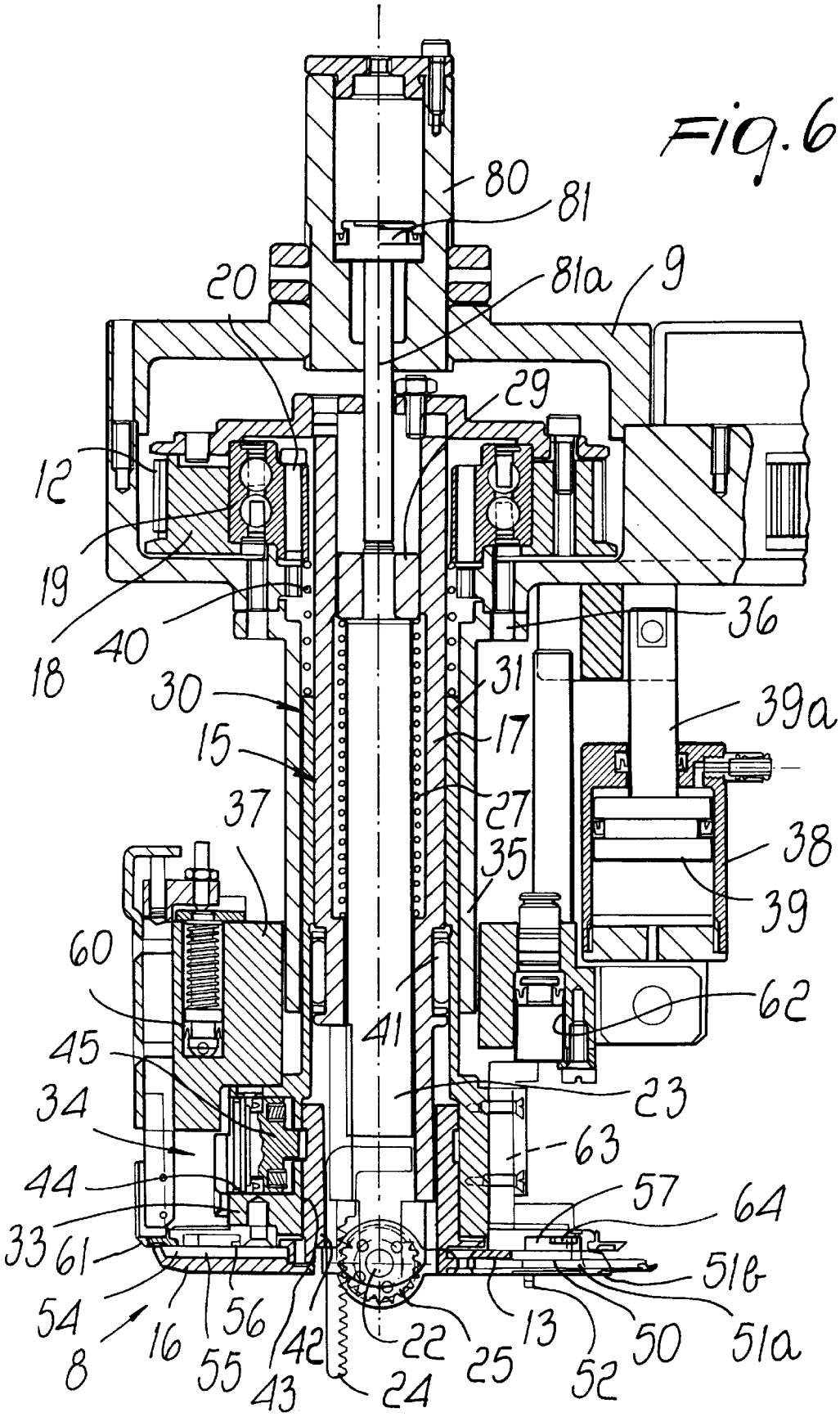

In this manner, the first half 13 of the circular plate is returned below the cams 57 which it faced before overturning, and the inside of the fluid-actuated cylinder 38 is connected to the discharge, causing, with the action of the spring 40, the lowering of the second supporting structure 30 and thus returning the first half 13 of the circular plate to a position which is co-planar with respect to the second half 16 of the circular plate (FIG. 6). By means of this operation, the heels 53 engage the cams 57, allowing to actuate the overturned hooks 51*b* upon the subsequent rotation of the circular plate.

By actuating the hooks 51*b* in an overturned position with respect to the initial position, it is possible to transfer loops or portions of loops from hooks 51*b* to the needles of the half of the needle cylinder that the first half 13 of the circular plate had been made to face during its overturning. By transferring the loops of the needles of one half of the needle cylinder to the needles of the other half of the needle cylinder, or by transferring portions of loops retained on the hooks of the first half 13 of the circular plate and joined to loops formed by the needles of one half of the needle cylinder to the needles of the other half of the needle cylinder, it is possible to form tubular items which are closed at one of their axial ends.

In practice, the first half 13 of the circular plate 8 can be used like the circular plate disclosed in German patent No. 16.35.992 or in any case so as to allow, even by means of other procedures, the formation of tubular knit items closed at an axial end.

After transferring the loops from the hooks of the first half 13 of the circular plate to the needles of the needle cylinder, the first half 13 of the circular plate can be returned to the position shown in FIG. 1, repeating in reverse sequence the operations described so far, or the circular plate constituted by the first overturned half 13 and by the second half 16 can in any case be used like a conventional circular plate. During a subsequent operating cycle for the transfer of loops or portions of loops from the hooks to the needles of the opposite half of the needle cylinder, the first half 13 of the circular plate is returned to the position shown in FIG. 1.

In practice it has been observed that the machine according to the invention fully achieves the intended aim, since it allows to form both tubular items closed at one of their axial ends and knitting which requires the use of a conventional circular plate, such as for example the formation of a turned-back hem at one end of the tubular item.

The machine thus conceived is susceptible of numerous modifications and variations, all of which are within the scope of the inventive concept; all the details may also be replaced with other technically equivalent elements.

In practice, the materials employed, as well as the dimensions, may be any according to the requirements and the state of the art.

What is claimed is:

1. A single-cylinder circular hosiery-making or knitting machine, particularly for manufacturing tubular items closed at one of their axial ends, comprising a needle cylinder and a circular plate which coaxially faces the needle cylinder in an upward region, wherein said circular plate is composed of two halves, a first half of said circular plate being pivoted to a first supporting structure about a diametrical axis which is substantially parallel to the diametrical connecting plane of the two halves of the circular plate, said first half of the circular plate being provided with radial grooves which accommodate pairs of hooks which can be actuated along the corresponding groove so as to engage or release loops or portions of loops of knitting formed by the needles of the needle cylinder, overturning means being provided for overturning said first half of the circular plate about said diametrical axis to transfer it from a first position, which is co-planar with respect to said second half of the circular plate, to a second position, which is overturned below said second half of the circular plate, and viceversa, said first half of the circular plate being rotatable, in said second position, rigidly with the needle cylinder about the axis of the needle cylinder with respect to said second half of the circular plate.

2. A machine according to claim 1, wherein said first half of the circular plate is supported by said first supporting structure which is rigidly coupled to said needle cylinder in its rotation about its own axis, said second half of the circular plate being supported by a second supporting structure, means being provided for moving said second supporting structure along the axis of the circular plate with respect to said first half of the circular plate in order to transfer said second half of the circular plate from a position which is co-planar to said first half of the circular plate to a position which is spaced above said first half of the circular plate and viceversa.

3. A machine according to claim 2, wherein said second supporting structure is rigidly coupled, in its rotation about the axis of the needle cylinder, to said first supporting structure of the machine.

4. A machine according to claim 2, further comprising locking means for locking the rotation of said second half of the circular plate about said diametrical axis, said locking means being activatable on command to lock said second half of the circular plate when said first half of the circular plate rotates with respect to said second half of the circular plate about the diametrical axis of the circular plate.

5. A machine according to claim 1, wherein said overturning means are mounted on said first supporting structure.

6. A machine according to claim 1, wherein each pair of hooks comprises a hook the tip whereof faces upwards and a hook the tip whereof faces downwards when said first half of the circular plate is in said first position.

7. A machine according to claim 6, wherein said diametrical axis is arranged substantially at the same level as a plane which is perpendicular to the axis of the circular plate and is equidistant from hollows of the tips and of the two hooks of the various pairs of hooks.

8. A machine according to claim 6, wherein the hooks with upward-facing tips have an actuation heel protruding upwards from said first half of the circular plate and in that the hooks with downward-facing tips have an actuation heel protruding downwards from said first half of the circular plate when said first half of the circular plate is in said first position, actuation cams for said hooks being arranged above said circular plate, said cams being connected to said second supporting structure and being engageable by said upward-protruding heels of the hooks of said first half of the circular plate when said first half of the circular plate is in said first position and by said downward-protruding heels when said first half of the circular plate is in said second position.

9. A machine according to claim 1, wherein said second half of the circular plate has radial grooves, each groove accommodating a hook with an upward-facing tip and with an actuation heel that protrudes upwards from said second half of the circular plate and can engage said actuation cams.

10. A machine according to claim 1, wherein said overturning means comprise a rack arranged parallel to the axis of said circular plate and supported by said first supporting structure, said rack meshing with a pinion which is rigidly coupled to said first half of the circular plate and is arranged coaxially about a pivot supported by said first supporting structure and providing said diametrical axis by means of its own axis.

* * * * *